US010532917B2

(12) United States Patent
Hall et al.

(10) Patent No.: US 10,532,917 B2
(45) Date of Patent: Jan. 14, 2020

(54) WINCH WITH IMPACT TRANSMISSION

(71) Applicants: David R. Hall, Provo, UT (US); Jerome Miles, Spanish Fork, UT (US); Daniel Madsen, Vineyard, UT (US); Benjamin Taylor, Provo, UT (US); Joe Fox, Spanish Fork, UT (US); Jedediah Knight, Provo, UT (US); Joseph Duncan, Provo, UT (US)

(72) Inventors: David R. Hall, Provo, UT (US); Jerome Miles, Spanish Fork, UT (US); Daniel Madsen, Vineyard, UT (US); Benjamin Taylor, Provo, UT (US); Joe Fox, Spanish Fork, UT (US); Jedediah Knight, Provo, UT (US); Joseph Duncan, Provo, UT (US)

(73) Assignee: Hall Labs LLC, Provo, UT (US)

( * ) Notice: Subject to any disclaimer, the term of this patent is extended or adjusted under 35 U.S.C. 154(b) by 186 days.

(21) Appl. No.: 15/241,589

(22) Filed: Aug. 19, 2016

(65) Prior Publication Data

US 2018/0050892 A1 Feb. 22, 2018

(51) Int. Cl.
*B66D 1/12* (2006.01)

(52) U.S. Cl.
CPC ..... *B66D 1/12* (2013.01); *B66D 2700/0141* (2013.01)

(58) Field of Classification Search
CPC ... B66D 1/02; B66D 1/12; B66D 1/14; B66D 1/16
See application file for complete search history.

(56) References Cited

U.S. PATENT DOCUMENTS

| | | | | |
|---|---|---|---|---|
| 5,249,777 | A * | 10/1993 | Herving | A01K 73/06 254/289 |
| 5,418,339 | A * | 5/1995 | Bowen | B25D 17/12 173/2 |
| 5,971,178 | A * | 10/1999 | Ratcliff | B66D 3/18 212/250 |
| 7,658,370 | B2 * | 2/2010 | Rotzler | B66D 1/58 254/274 |
| 2015/0000946 | A1 * | 1/2015 | Amend | B25B 21/026 173/93 |
| 2018/0029204 | A1 * | 2/2018 | Koyuncu | B25B 13/50 |

* cited by examiner

*Primary Examiner* — Michael R Mansen
*Assistant Examiner* — Nathaniel L Adams

(57) ABSTRACT

A winch mechanism is described that includes a motor, a drum mechanism, a winch line, and a hammer and anvil mechanism. The drum mechanism is connected to the motor, and the winch line is connected to the drum. The hammer and anvil mechanism is connected to the motor and the drum mechanism within the drum mechanism. The motor activates the hammer and anvil mechanism, and the hammer and anvil mechanism applies a percussive force to the drum mechanism as the drum winds up the winch line. In an alternative embodiment, the hammer and anvil mechanism is disposed around at least a portion of the drum mechanism.

20 Claims, 14 Drawing Sheets

WINCH WITH IMPACT TRANSMISSION

TECHNICAL FIELD

This invention relates generally to the field of winches and hoists.

BACKGROUND

Winches and hoists have proven indispensable tools in moving objects of considerable size. As technology has advanced, improvements have been incorporated into winches and hoists that enhance performance while still preserving essential functions. However, in recent decades, improvement of winches and hoists has stagnated at the incorporation of direct drive electric motors. Solutions presented for increasing the power of winches and hoists have been to increase the size of the accompanying motor. This therefore significantly limits the power available in any application to the space available for the motor, the weight of the motor that can be reasonably supported, and, in some cases, the amount of power that is available for the motor. For example, in cases where a winch is powered by an automotive battery and/or alternator, the amount of available torque is limited by the amount of amperage available to directly turn the winch motor and the weight supportable by the vehicle. Thus, there is a need for a solution that increases torque without requiring additional energy input and/or size.

SUMMARY OF THE INVENTION

An impact-driven winch mechanism is described herein that overcomes many of the limitations described above. In general, the winch includes a motor, drum, winch line, and an impact mechanism connected to the motor that rotates the drum. The claimed invention solves several problems associated with winches. Chief among those problems, the claimed invention addresses torque limitations by doubling to tripling, or more, the amount of torque produced by the winch while maintaining the same size, weight and required power input.

In one embodiment of the claimed invention, a winch mechanism is described that includes a motor, a drum mechanism, a winch line, and a hammer and anvil mechanism. The drum mechanism is connected to the motor, and the winch line is connected to the drum. The hammer and anvil mechanism is connected to the motor and the drum mechanism within the drum mechanism. The motor activates the hammer and anvil mechanism, and the hammer and anvil mechanism applies a percussive force to the drum mechanism as the drum winds up the winch line.

In another embodiment of the claimed invention, a winch mechanism is described that includes a motor, a drum mechanism, a winch line, and a hammer and anvil mechanism. Similar to the embodiment mentioned above, in this embodiment the drum mechanism is connected to the motor, and the winch line is connected to the drum. However, instead of being positioned in the drum, in this embodiment the hammer and anvil mechanism is connected to the motor and the drum mechanism around at least a portion of the drum mechanism. The motor activates the hammer and anvil mechanism, and the hammer and anvil mechanism applies a percussive force to the drum mechanism as the drum winds up the winch line.

BRIEF DESCRIPTION OF THE DRAWINGS

A more particular description of the invention briefly described above is made below by reference to specific example embodiments. Several example embodiments are depicted in drawings included with this application, in which.

DETAILED DESCRIPTION

Figure 1A:
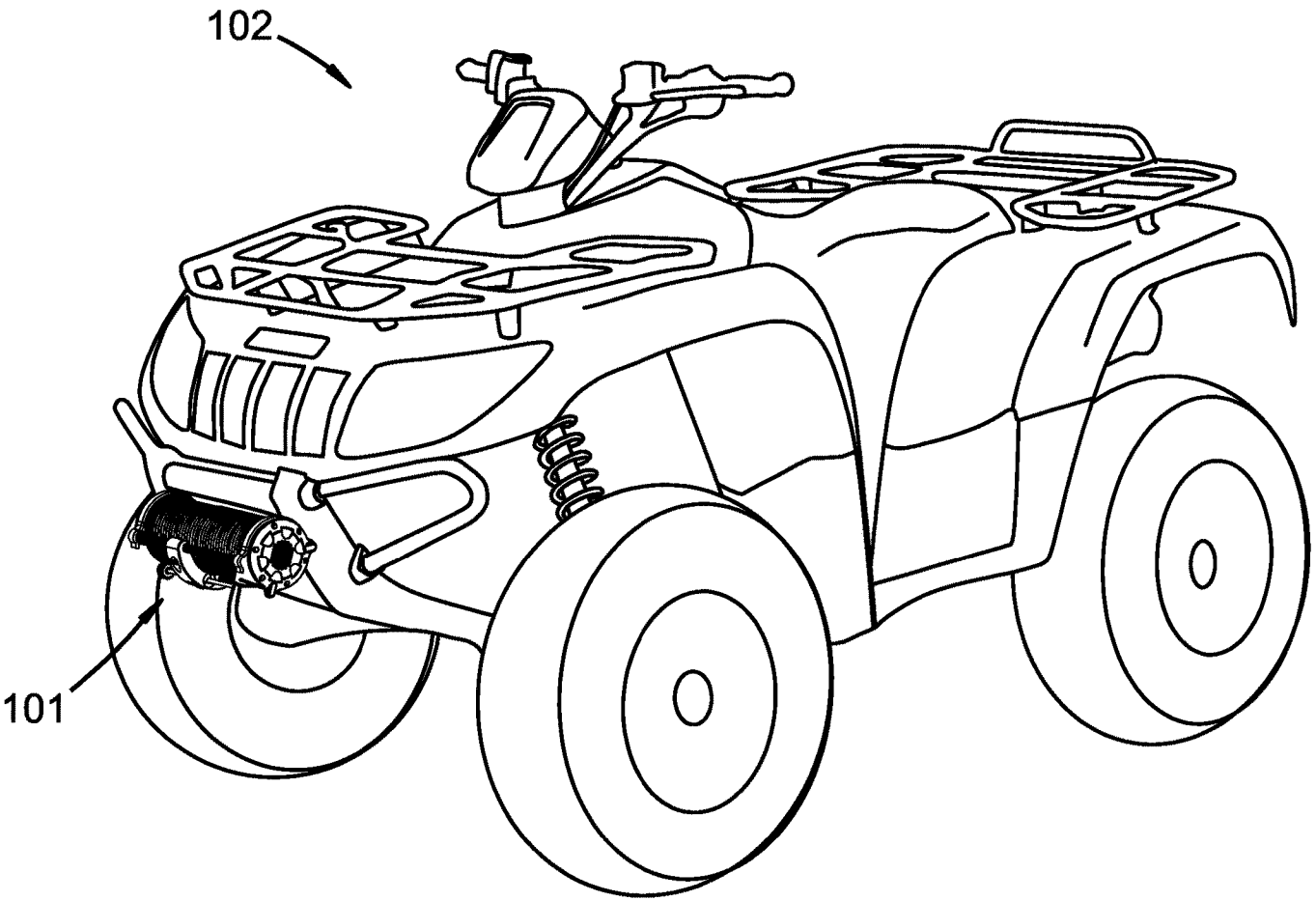
FIGS. 1A-E depict various embodiments of implementations of a winch mechanism according to the claimed invention.
Figure 1B:
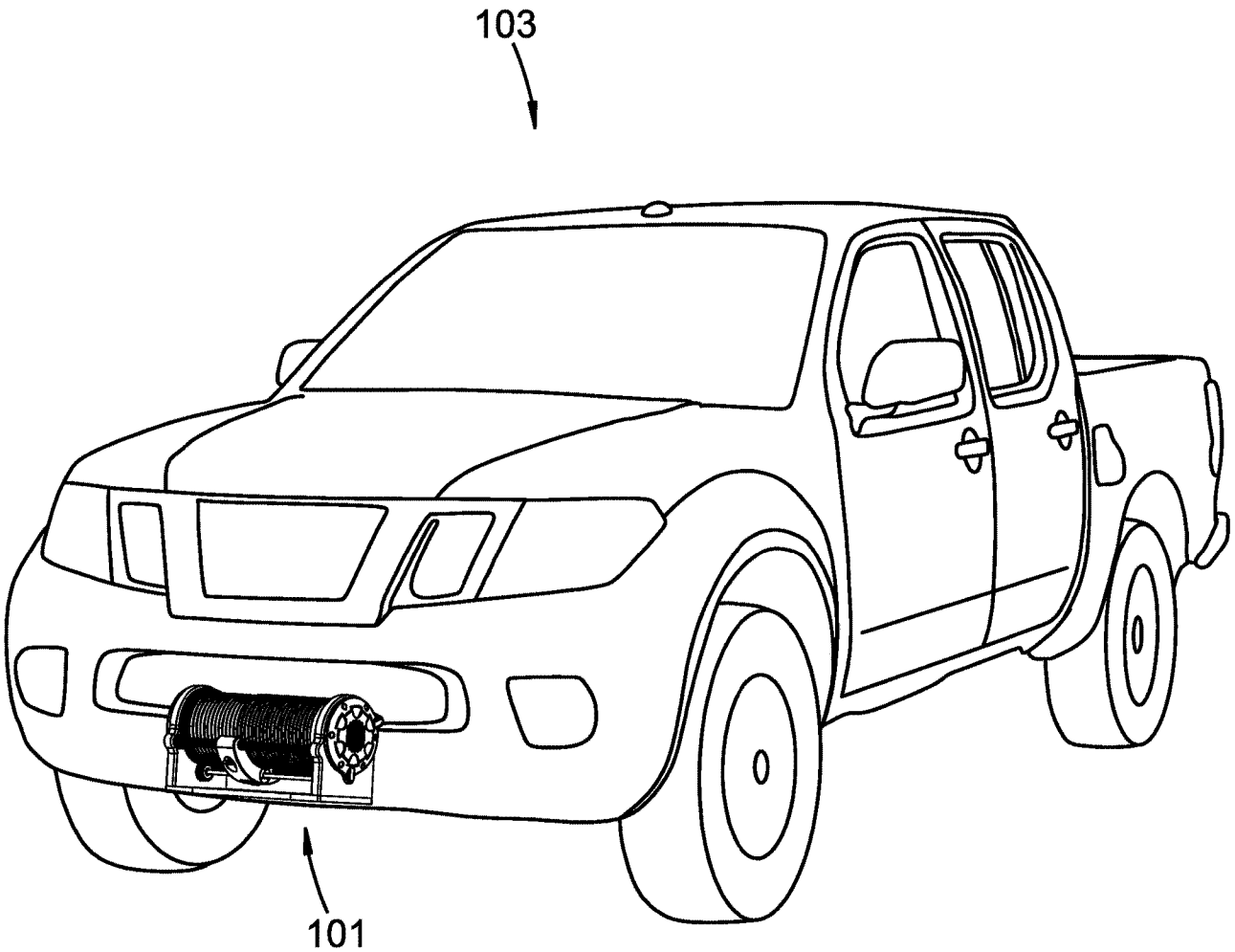
Figure 1C:
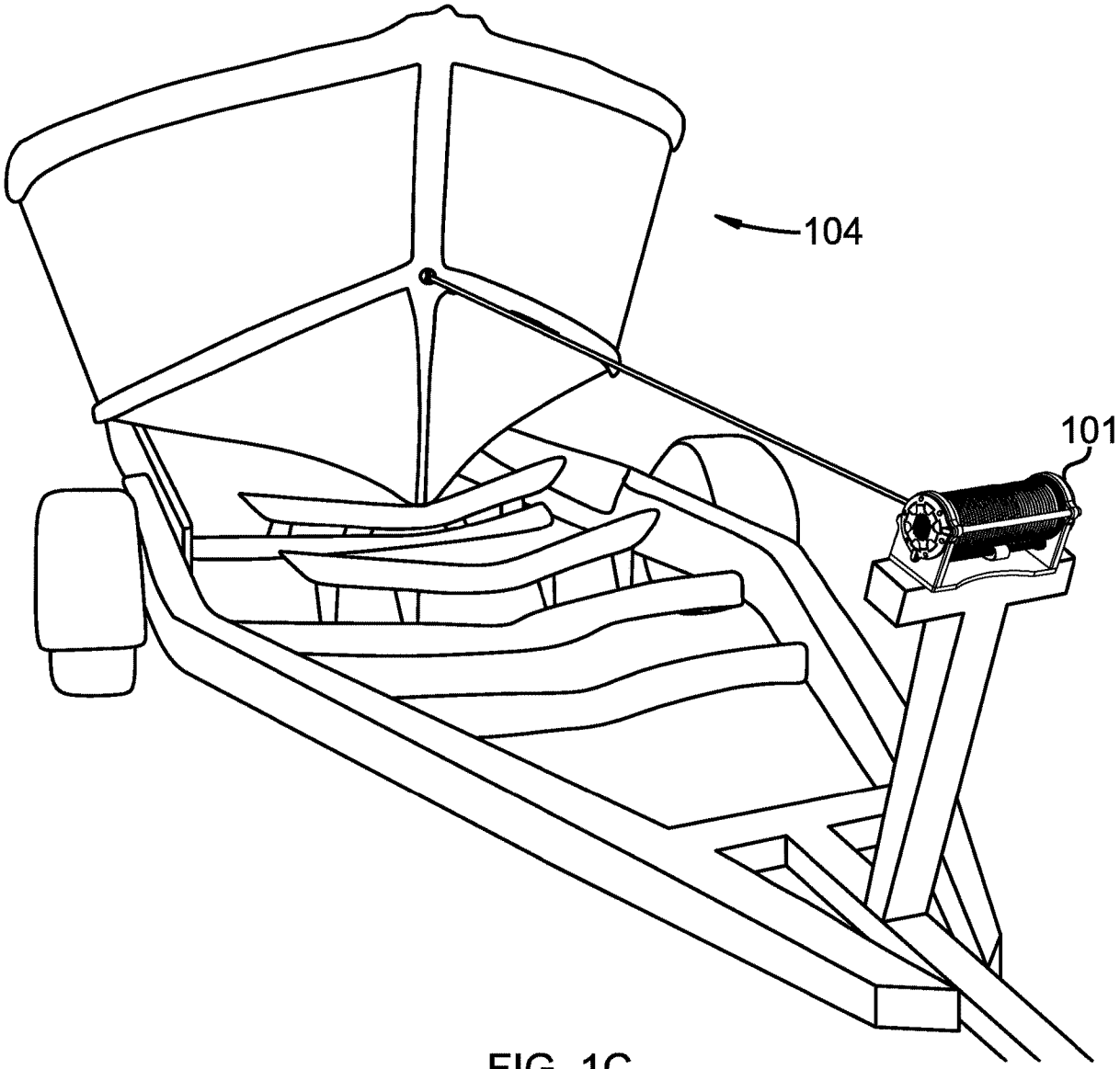
Figure 1D:
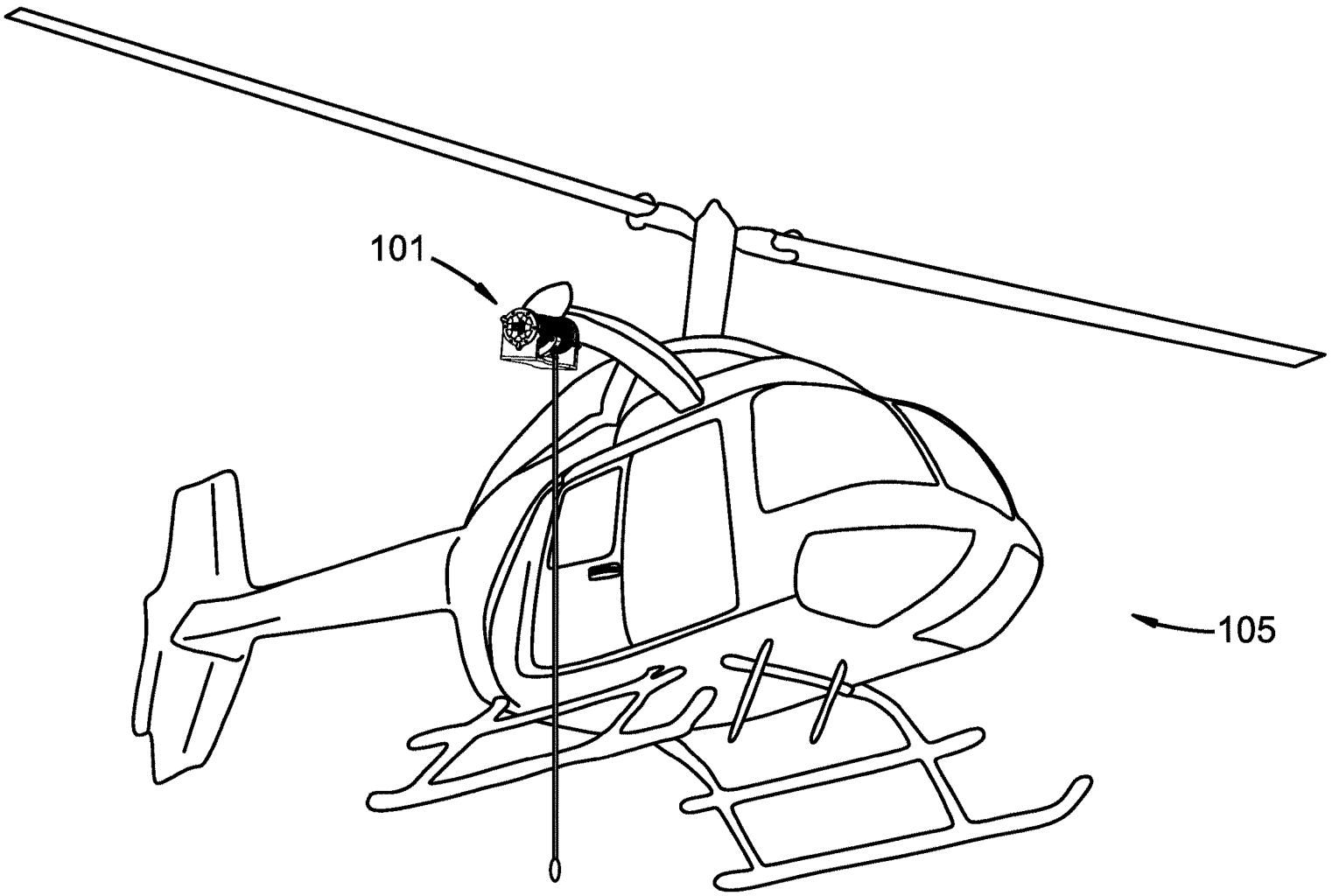
Figure 1E:
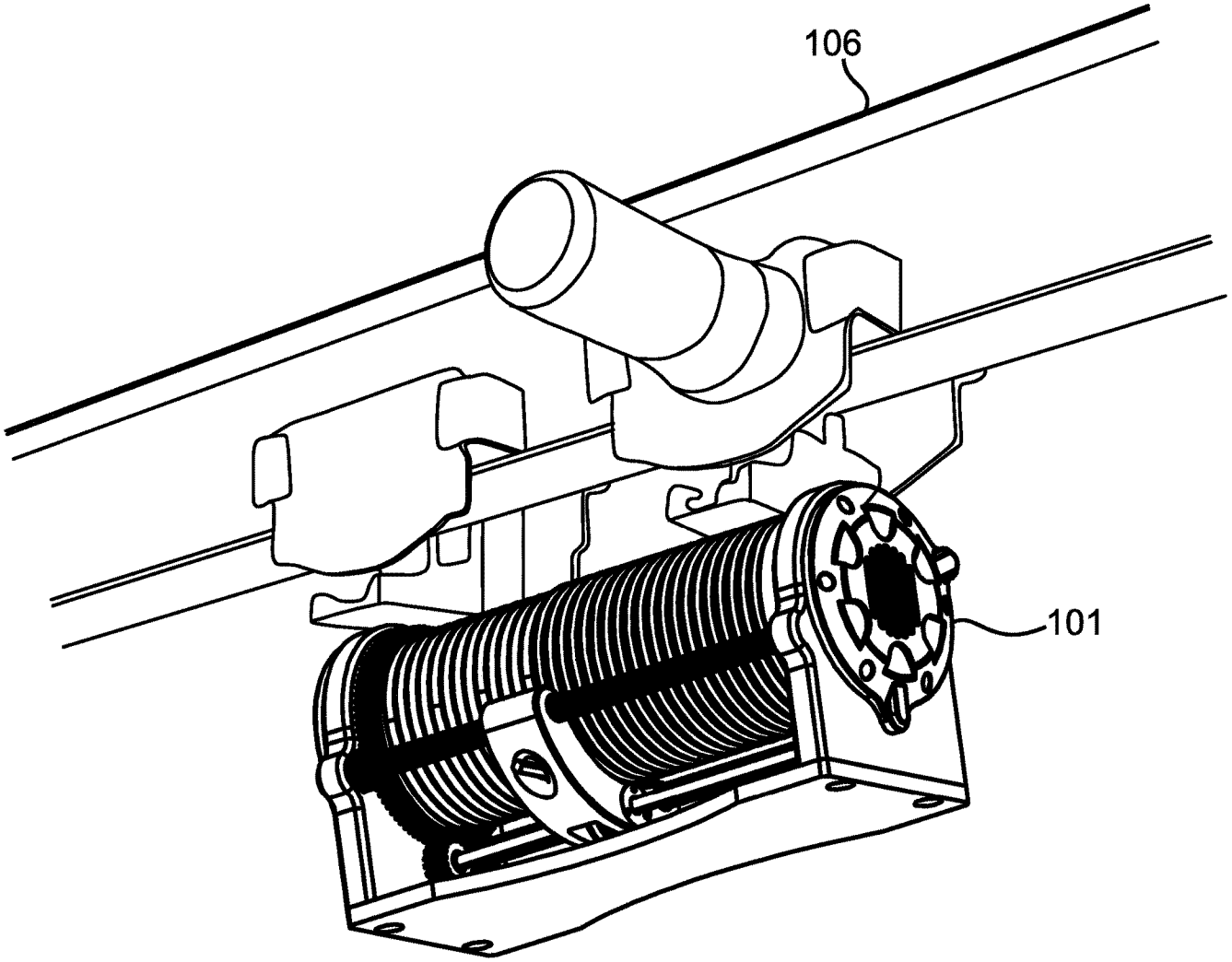

A detailed description of the claimed invention is provided below by example, with reference to embodiments in the appended figures. Those of skill in the art will recognize that the components of the invention as described by example in the figures could be arranged and designed in a wide variety of different configurations. Thus, the detailed description of the embodiments in the figures is merely representative of embodiments of the invention, and is not intended to limit the scope of the invention as claimed.

The descriptions of the various embodiments include, in some cases, references to elements described with regard to other embodiments. Such references are provided for convenience to the reader, and to provide efficient description and enablement of each embodiment, and are not intended to limit the elements incorporated from other embodiments to only the features described with regard to the other embodiments. Rather, each embodiment is distinct from each other embodiment. Despite this, the described embodiments do not form an exhaustive list of all potential embodiments of the claimed invention; various combinations of the described embodiments are also envisioned, and are inherent from the descriptions below of the various embodiments. Additionally, embodiments not described below that meet the limitations of the claimed invention are also envisioned, as is recognized by those of skill in the art.

Throughout the detailed description, various elements are described as "off-the-shelf." As used herein, "off-the-shelf" means "pre-manufactured" and/or "pre-assembled."

In some instances, features represented by numerical values, such as dimensions, quantities, and other properties that can be represented numerically, are stated as approximations. Unless otherwise stated, an approximate value means "correct to within 50% of the stated value." Thus, a length of approximately 1 inch should be read "1 inch+/−0.5 inch." Similarly, other values not presented as approximations have tolerances around the stated values understood by those skilled in the art. For example, a range of 1-10 should be read "1 to 10 with standard tolerances below 1 and above 10 known and/or understood in the art."

FIGS. 1A-E depict various embodiments of implementations of a winch mechanism according to the claimed invention. In some embodiments, winch 101 is useful for use on an off-highway vehicle, such as ATV 102. In some embodiments, winch 101 is useful for use on other types of wheeled vehicles, such as truck 103. In other embodiments, winch 101 is useful for use with any of a variety of recreational vehicles, such as boat 104. In yet other embodiments, winch 101 is useful for use with any of a variety of emergency vehicles, such as rescue helicopter 105. And in other embodiments, winch 101 is useful for use in industrial settings, such as being coupled to I-beam 106 in a manufacturing facility. While only a few examples are depicted, those of skill in the art recognize that FIGS. 1A-E are merely representative of a wide host of technical fields in which winch 101 is useful.

Figure 2:
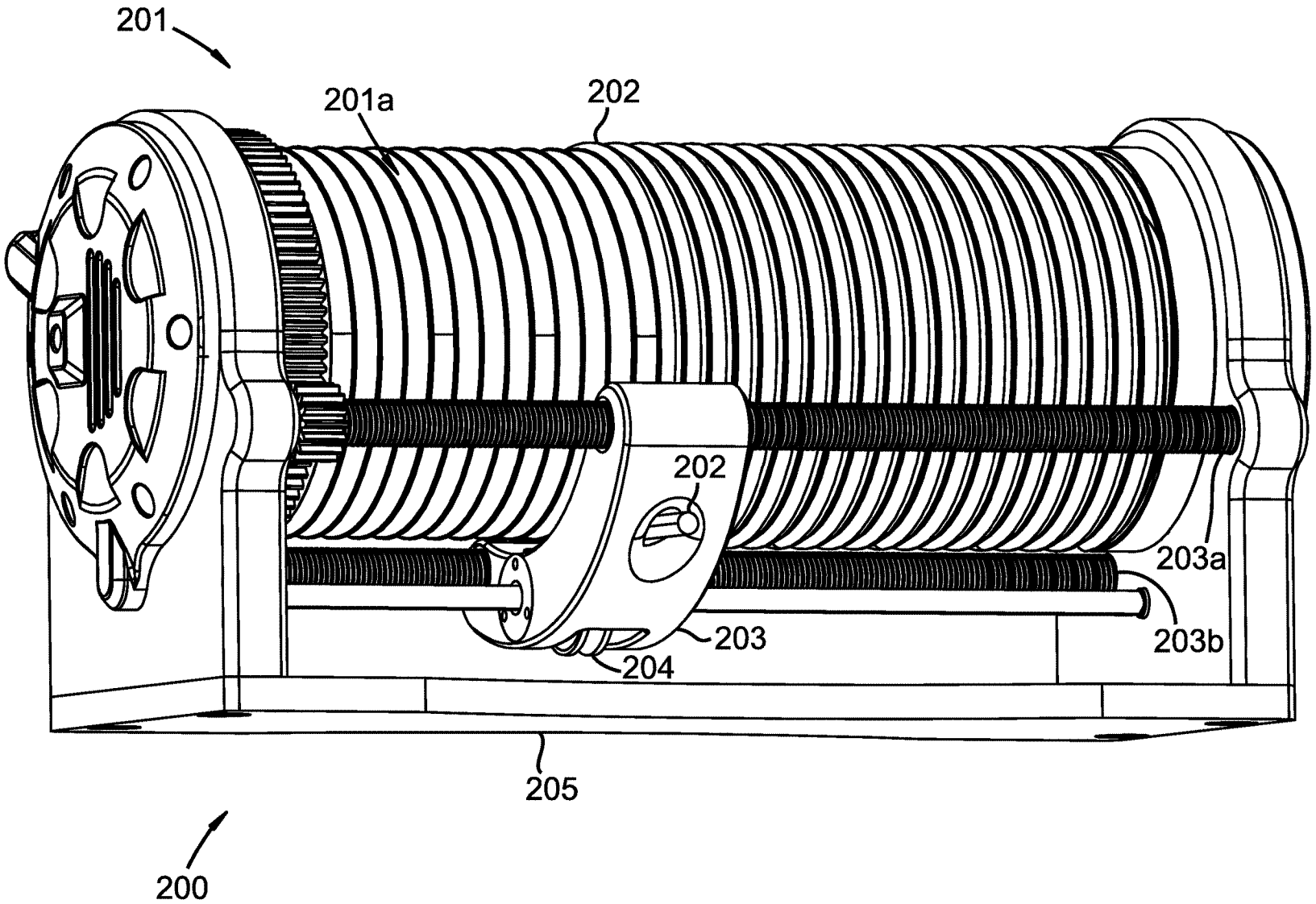
FIG. 2 depicts an outside isometric view of a winch mechanism in accordance with the claimed invention.

FIG. 2 depicts an outside isometric view of a winch mechanism in accordance with the claimed invention. Winch mechanism 200 includes drum mechanism 201 and winch line 202. Additionally depicted, and included in some embodiments of the claimed invention, are line guide 203, tensioner 204, and mount 205. Winch line 202 is connected to drum mechanism 201, which winds and pays out winch line 202. Winch 200 also includes, in some embodiments, a motor disposed at least partially within drum 201 (such as is depicted in, and described with regard to, FIGS. 3-6 and 8A-B). In other embodiments, the motor is disposed adjacent to drum 201. In the depicted embodiment, however, the motor is disposed completely within drum 201 (and therefore not visible in the depicted view). Connected to the motor within the drum is a hammer and anvil mechanism (such as is depicted in, and described with regard to, FIGS. 3-5 and 7A-8B) The motor, via the hammer and anvil mechanism, applies torque to drum 201 and enables drum 201 to draw in and let out line 202. Tensioner 204 is positioned adjacent to drum 201 such that line 202 passes between tensioner 204 and drum 201 and is in frictional contact with tensioner 204 and drum 201. Additionally, tensioner 204 rotates with a linear speed exceeding a linear speed of drum 201 as line 202 is let out from drum 201, and rotates freely as line 202 is drawn onto drum 201.

Drum 201 is, in many embodiments, a right circular cylindrical drum. However, in some embodiments, drum 201 is any of a variety of cylindrical shapes, such as an elliptic cylinder, a parabolic cylinder, a hyperbolic cylinder, and/or an oblique cylinder. In yet other embodiments, drum 201 is a cuboid, a rounded cuboid, a triangular prism, and/or any of a variety of other polyhedral shapes. Additionally, in some embodiments, drum 201 is hollow, such as in embodiments where the motor and the hammer and anvil mechanism are positioned within drum 201. In other embodiments, drum 201 is partially hollow or completely solid, such as in embodiments where the hammer and anvil mechanism is around the outside of drum 201. Additionally, as depicted, in some embodiments, drum 201 includes helical groove 201*a* that guides line 202 as line 202 is wound onto drum 201.

Line 202 winds around drum 201, and is made any of a variety materials compatible with use on a winch, such as nylon, polypropylene, polyester, UHMWPE, aramid, cotton, Kevlar, steel cable, and/or coated steel cable, among others. Additionally, in some embodiments, line 202 is a rope, whereas in other embodiments line 202 is a strap. In some embodiments line 202 comprises a wear-resistant material sufficient to withstand wear from tensioner 204 for longer than a service life of line 202. As used herein, "service life" refers to a number of uses of line 202 before line 202 frays or otherwise deteriorates from load-bearing such that the line can no longer sustain loads for which the line is useful and/or the winch can tolerate. In some embodiments, line 202 comprises a tribological material having a coefficient of friction greater than 1.

Line guide 203 guides line 202 as line 202 pays out from, and is drawn onto, drum 201. In some embodiments, line guide 203 is coupled to drum 201 by threaded rods 203*a,b*. Threaded rods 203*a,b* enable line guide 203 to accurately spool line 202 onto drum 201 and into grooves 201*a*. In other embodiments, line guide 203 slides along smooth rods and assists grooves 201*a* in spooling line 202.

Tensioner 204 includes, in the depicted embodiment, a wheel positioned in line guide 203. However, tensioner 204 includes, in other embodiments, any of a variety of shapes sufficient for providing payout tension to line 202 as line 202 is payed-out from drum 201. The payout tension causes line 202 to remain firmly wrapped around drum 201 as it is payed-out so that it does not back up on drum 201 and cause the rest of line 202 on drum 201 to loosen and/or tangle. Thus, in some embodiments, tensioner 204 includes a sphere or a belt. In other embodiments, tensioner 204 includes teeth that bite into line 202. In some embodiments, such as the depicted embodiment, tensioner 204 includes groove 204*a* that fits around line 202 to provide greater surface area for frictional contact between tensioner 204 and line 202.

Mount 205 mounts winch 200 to any of a variety of mounting surfaces in any of a variety of orientations, such as horizontal, vertical, right-side up, and upside down. Thus, mount 205 is made of any of a variety of materials sufficient to withstand torque created by winch 200 bearing a load and, in some cases, additional torque caused by gravity. In some embodiments, mount 205 is a steel and/or aluminum alloy. In other embodiments, mount 205 is a hardened and/or thermoset plastic, such as nylon, acrylic, HDPE, and/or melamine. In some embodiments, mount 205 is an anti-vibration surface mount. For example, in some embodiments, mount 205 and includes, or consists of, sorbothane, neoprene, nitrile, cork, rubber, or combinations thereof.

Figure 3:
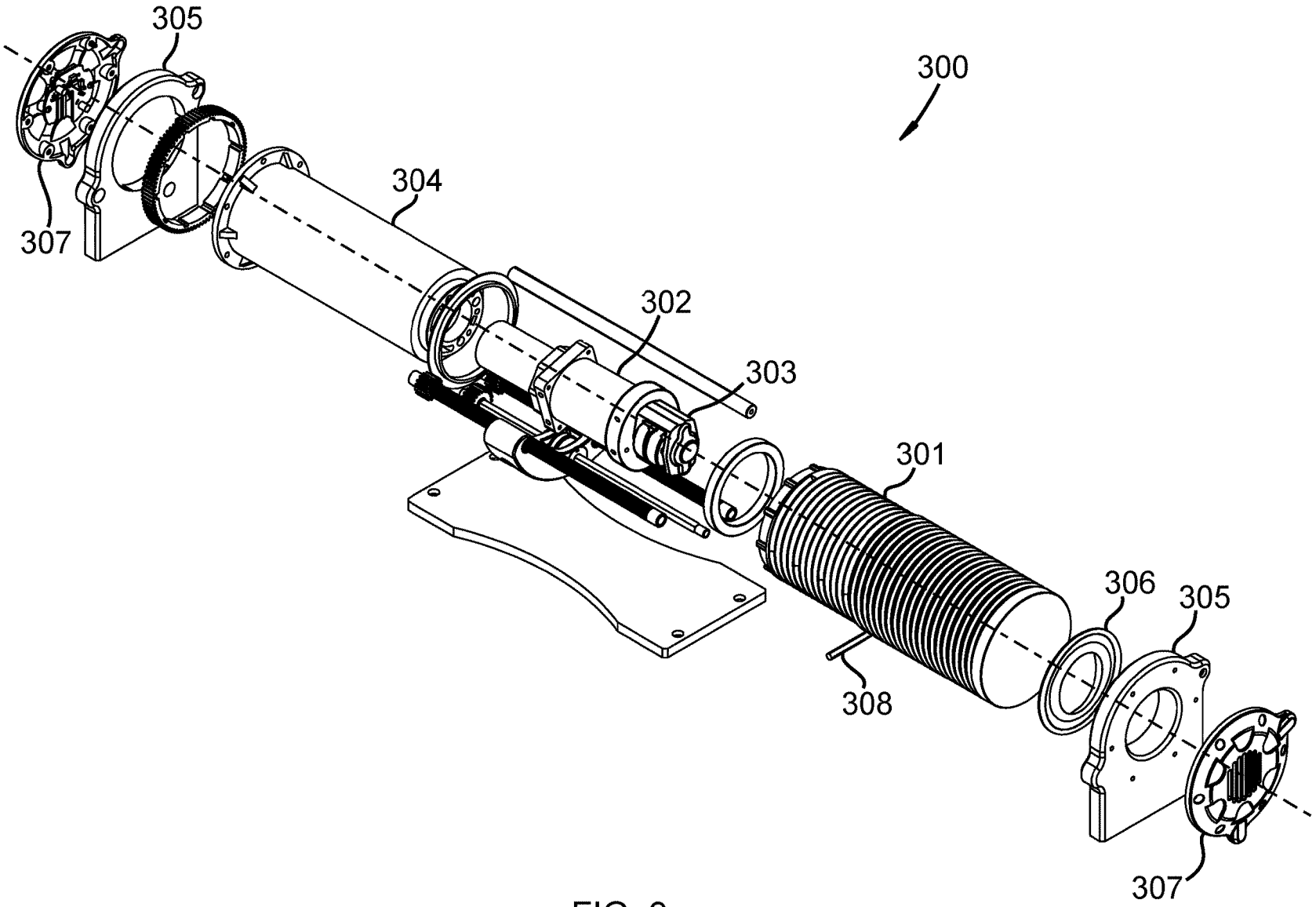
FIG. 3 depicts an exploded view of a winch mechanism consistent with the claimed invention.

FIG. 3 depicts an exploded view of a winch mechanism consistent with the claimed invention. Winch mechanism 300 includes drum 301, motor 302, hammer and anvil mechanism 303, motor housing 304, side supports 305, one-way freewheel clutch 306, and end caps 307. Various components, including drum 301, side supports 305, one-way freewheel clutch 306, and end caps 307 form a drum mechanism, similar to that described above with regard to FIG. 2. The drum mechanism is connected to motor 302 via one or more of side supports 305, motor housing 304, and/or hammer and anvil mechanism 303. For example, as depicted, motor 302 is coupled directly to the inside of motor housing 304. Motor housing 304 is, in turn, coupled to one side support 305. Alternatively, or in addition, hammer and anvil mechanism 303 is coupled to motor 302 and drum 301. Coupling of a hammer and anvil mechanism, such as mechanism 303, to the drum mechanism and a motor such as motor 302 is described in more detail below with regard to FIGS. 4, 5, and 7A-8B.

Similar to that described above with regard to FIG. 2, motor 302 rotates drum 301 via hammer and anvil mechanism 303. Motor 302 is any of a variety of AC and/or DC electric motors. Similarly, motor 302 is powered in any of a variety of ways. In some embodiments, motor 302 includes a 110V power cord that powers motor 302 via mains electricity. In other embodiments, motor 302 is a high-powered winch that requires a 220V line. In some embodiments, though, motor 302 is powered by any of a variety of off-grid sources, such as a battery and/or solar cells. Motor 302 is contained at least partially within housing 304, which is within drum 301, and which shields motor 302 from rotating drum 301 and fixes motor 302 to side supports 305. Side supports 305 provide counter-forcing support to motor 302 so that motor 302 can transfer power to drum 301. In some embodiments, such as that depicted in, and described with regard to, FIG. 2 above, motor 302 is completely within housing 304 and, thus, completely within drum 301.

Hammer and anvil mechanism 303 is coupled to motor 302 and drum 301. In some embodiments, such as the present embodiments and the embodiments described above with regard to FIG. 2, hammer and anvil mechanism 303 is disposed within drum 301. In other embodiments, such as embodiments described below with regard to FIGS. 8A-B, hammer and anvil mechanism 303 is disposed around at least a portion of drum 301. In some embodiments, a hammer portion of hammer and anvil mechanism 303 is coupled to motor 302, and an anvil portion of hammer and anvil mechanism 303 is coupled to the drum mechanism, such as to drum 301. In other embodiments, the anvil portion is an integrated part of the drum mechanism (such as is depicted in, and described below with regard to, FIGS. 5 and 8A-B). Motor 302 activates hammer and anvil mechanism 303, in some embodiments, by rotating the hammer portion with a significantly higher rotational velocity than a velocity at which motor 302 could rotate drum 301 directly, albeit with the same overall amount of energy. The hammer portion slams into, or "impacts" the anvil portion, rotating the anvil portion and, in turn, drum 301. In this way, hammer and anvil mechanism 303 applies a percussive force to the drum mechanism that rotates drum 301 and winds winch line 308 onto the drum mechanism.

Side supports 305 provide load-bearing support for the drum mechanism. As depicted, the drum mechanism includes two side supports 305. However, embodiments are envisioned with one side support, and with a plurality of side supports 305. In some embodiments with one side support 305, all drum mechanism components are mounted to one side of the single side support 305, and motor 302 and motor housing 304 are mounted to the opposite side of side support 305. In some embodiments with a plurality of side supports 305, one or more side supports 305 are disposed along the length of drum 301. Such would be a beneficial structure in embodiments where, for example, drum 301 winds several separate lines 308 at the same rate and using a single motor 302. In some such embodiments, motor 302 is coupled directly to one or more of the plurality of side supports 305.

One-way freewheel clutch 306 fits into or around, and is coupled to, one end of drum 301 and into one side support 305. Clutch 306 allows drum 301 to rotate freely in one direction, but prevents rotation in the opposite direction. Drum 301 is rotated in the free direction by the hammer portion impacting the anvil portion, and thereby winds line 308 onto drum 301. Between impacts, clutch 306 prevents reverse rotation of drum 301 that would unwind line 308 from drum 301. In some embodiments, clutch 306 is selectively coupled to drum 301, such as by one or more solenoids and armatures, to allow unwinding of line 308 from drum 301. Although only one clutch 306 is depicted, in some embodiments, a plurality of clutches 306 are included.

End caps 307 enclose the other components of winch 300 and, in some embodiments, such as the depicted one, allow for ventilation of motor 302. Additionally, in some embodiments, at least one endcap 307 holds electronic controls for motor 302.

Figure 4:
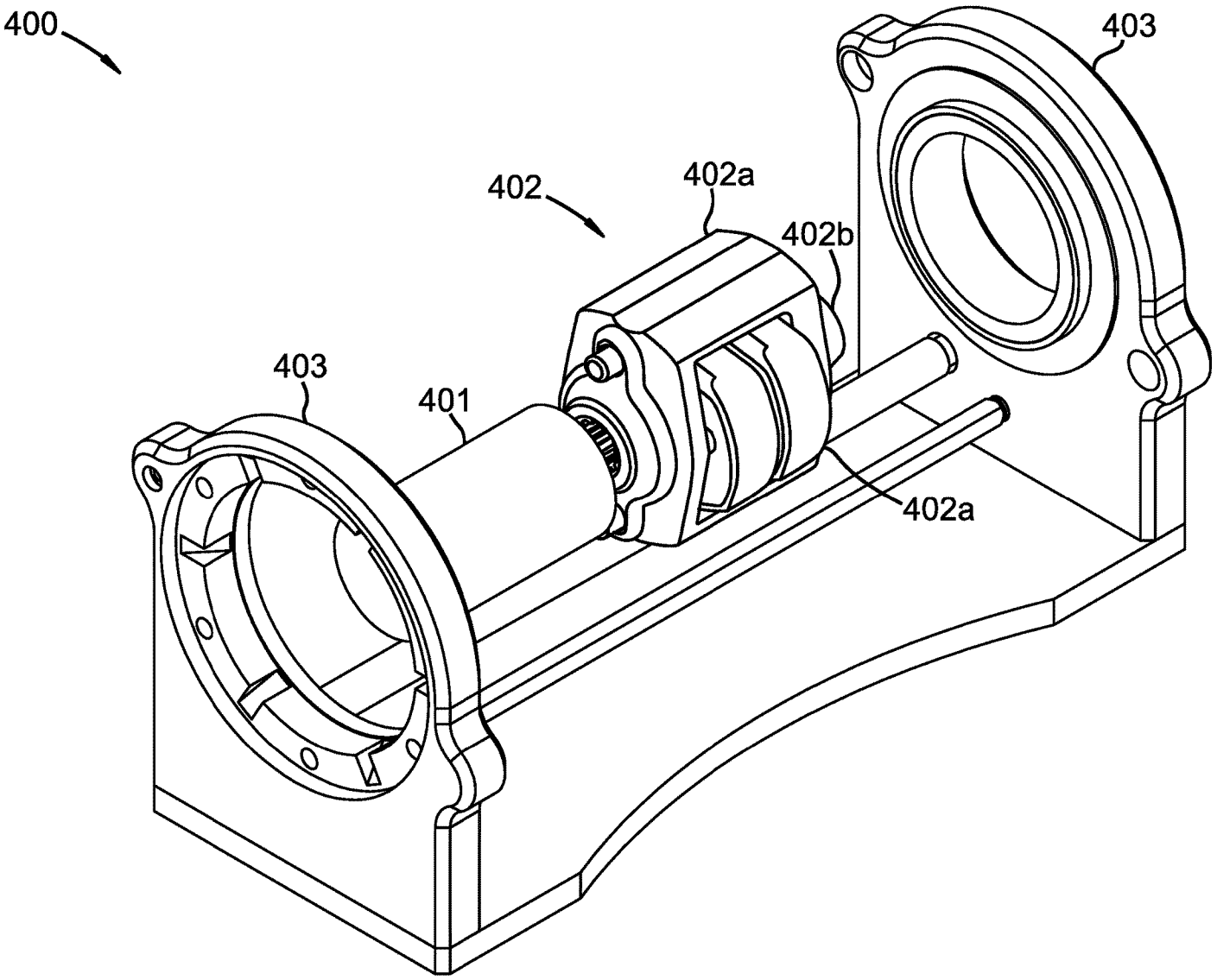
FIG. 4 depicts an isometric view of internal components of a winch mechanism that is in line with the claimed invention.

FIG. 4 depicts an isometric view of internal components of a winch mechanism that is in line with the claimed invention. Winch mechanism 400 includes motor 401 and hammer and anvil mechanism 402, including hammer 402*a*, and anvil 402*b*. In the depicted embodiment, hammer and anvil mechanism 402 is twin hammer clutch. However, other types of hammer and anvil mechanisms are also suitable. In general, suitable mechanisms avoid designs with a spring between the motor and the hammer, such as is found in impact drivers. Such suitable mechanisms include a pin clutch hammer and anvil mechanism, a rocking dog hammer and anvil mechanism, and a double dog hammer and anvil mechanism, among others. Winch mechanism 400 generally includes at least one, if not more, of such mechanisms, a few examples of which are depicted in, and described with regard to, FIGS. 7A-B below.

Impact driver designs are generally unsuitable because the spring between the motor and the hammer absorbs a significant portion of energy that should be transferred to the anvil. However, impact driver designs can be made suitable for the winch mechanisms described herein when the spring is affixed directly to, for example a side support, such as side support 403 in the depicted embodiment. A suitable embodiment of a design similar to an impact driver is described with regard to FIGS. 8A-B below.

Figure 5:
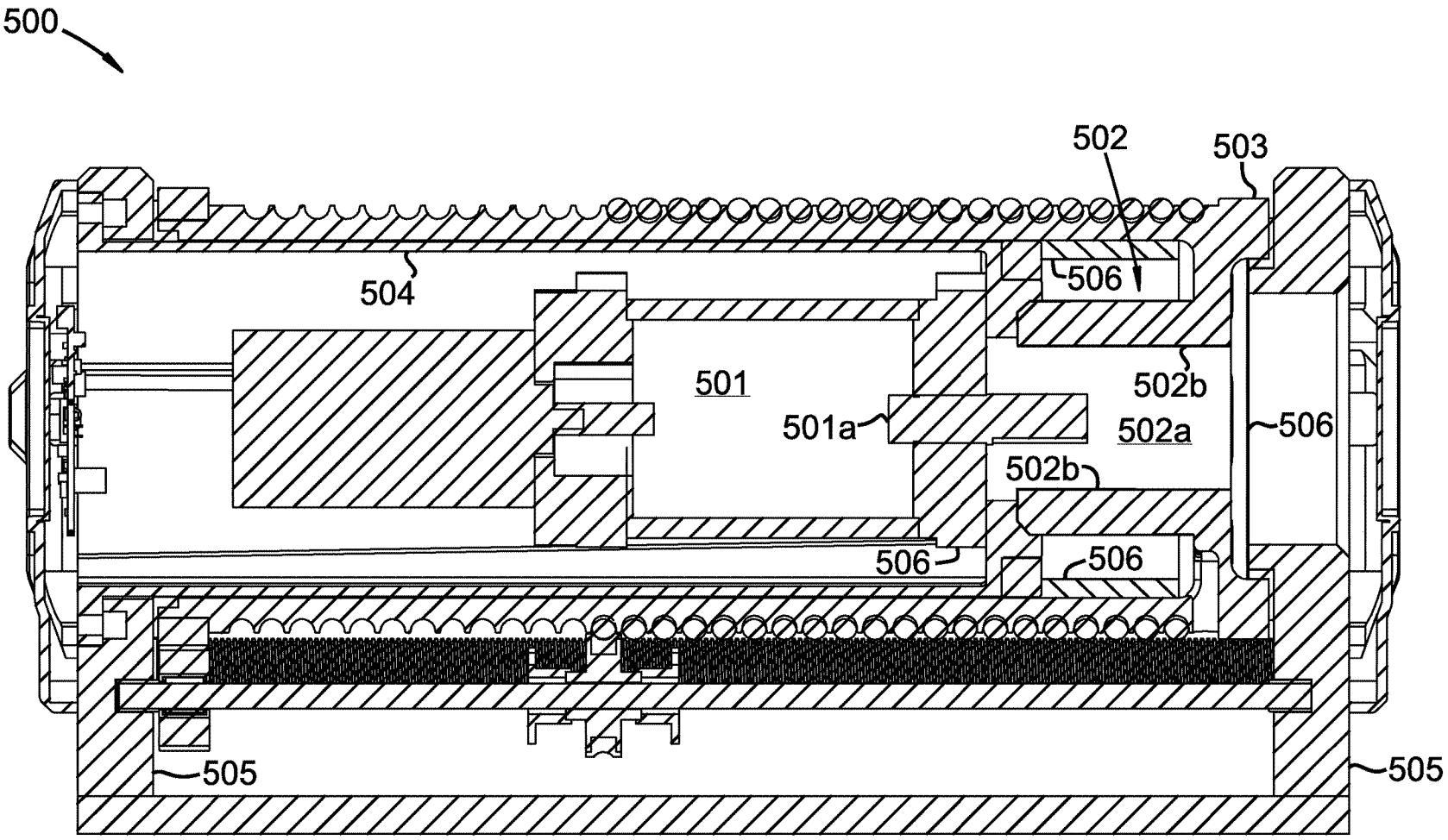
FIG. 5 depicts a side cross-sectional view of a winch mechanism incorporating elements of the claimed invention.

FIG. 5 depicts a side cross-sectional view of a winch mechanism incorporating elements of the claimed invention. Winch mechanism 500 includes motor 501, hammer and anvil mechanism 502, including hammer 502*a* and anvil 502*b*, drum 503, motor housing 504, side supports 505, and sound-proof material 506. Motor 501 transfers power to hammer 502*a* via power transfer rod 501*a*, and hammer 502*a* in turn transfers energy to anvil 502*b*, which is an integrated part of drum 503. Hammer and anvil mechanism 502 is different from mechanism 402 depicted in FIG. 4 in that the hammer 502*a* is disposed within anvil 502*b*. In such an embodiment, hammer 502 is of such a size and density that hammer 502 weighs at least as much as, if not more than, drum 503. Indeed, any embodiment benefits from a hammer having a weight greater than the weight of the drum.

Sound-proof material 506 surrounds at least a portion of hammer and anvil mechanism 502 to reduce noise heard by a user that is produced by hammer 502*a* impacting anvil 502*b*. In some embodiments, sound-proof material 506 completely surrounds hammer and anvil mechanism 502. For example, in some embodiments, one or more of drum 503, motor housing 504, and side supports 505 includes sound-proof material 506. Sound-proof material 506 is any of a variety of sound-dampening and/or sound-absorbing materials and/or structures. For example, some such materials include, but are not limited to, mass-loaded vinyl, Acoustiblok (a barium-free mass loaded membrane material), acoustic foam, and/or combinations thereof.

Figure 6:
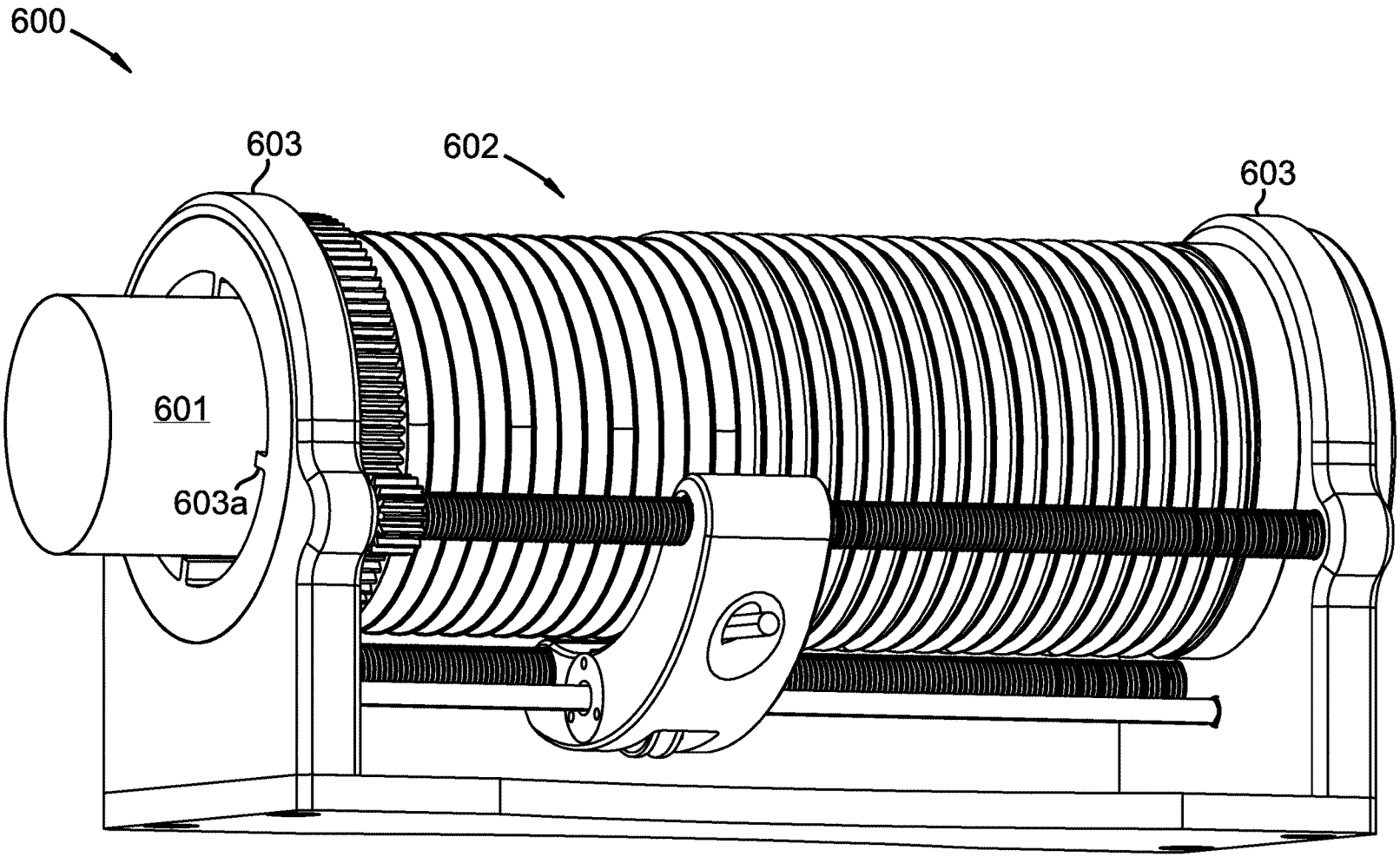
FIG. 6 depicts an embodiment of a winch mechanism with a motor positioned partially outside a drum.

FIG. 6 depicts an embodiment of a winch mechanism with a motor positioned partially outside a drum. Winch mechanism 600 includes motor 601, drum 602, and side supports 603. Motor 601 is coupled to, and supported by, side supports 603 via one or more tabs 603*a* which protrude from side support 603 and into motor 601.

Figure 7A:
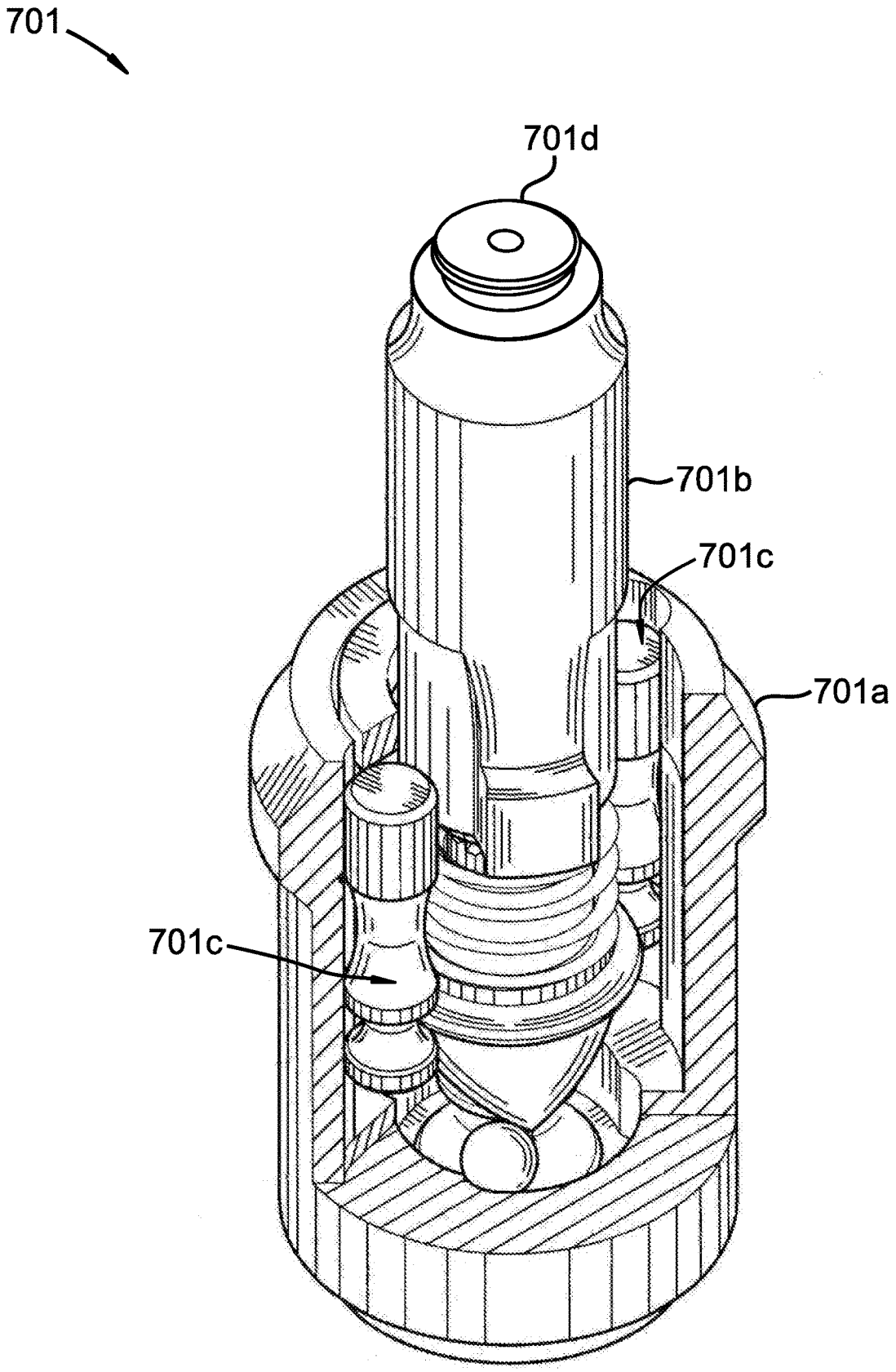
FIGS. 7A-B depict two types of hammer and anvil mechanisms suitable for use with a winch mechanism following the claimed invention.
Figure 7B:
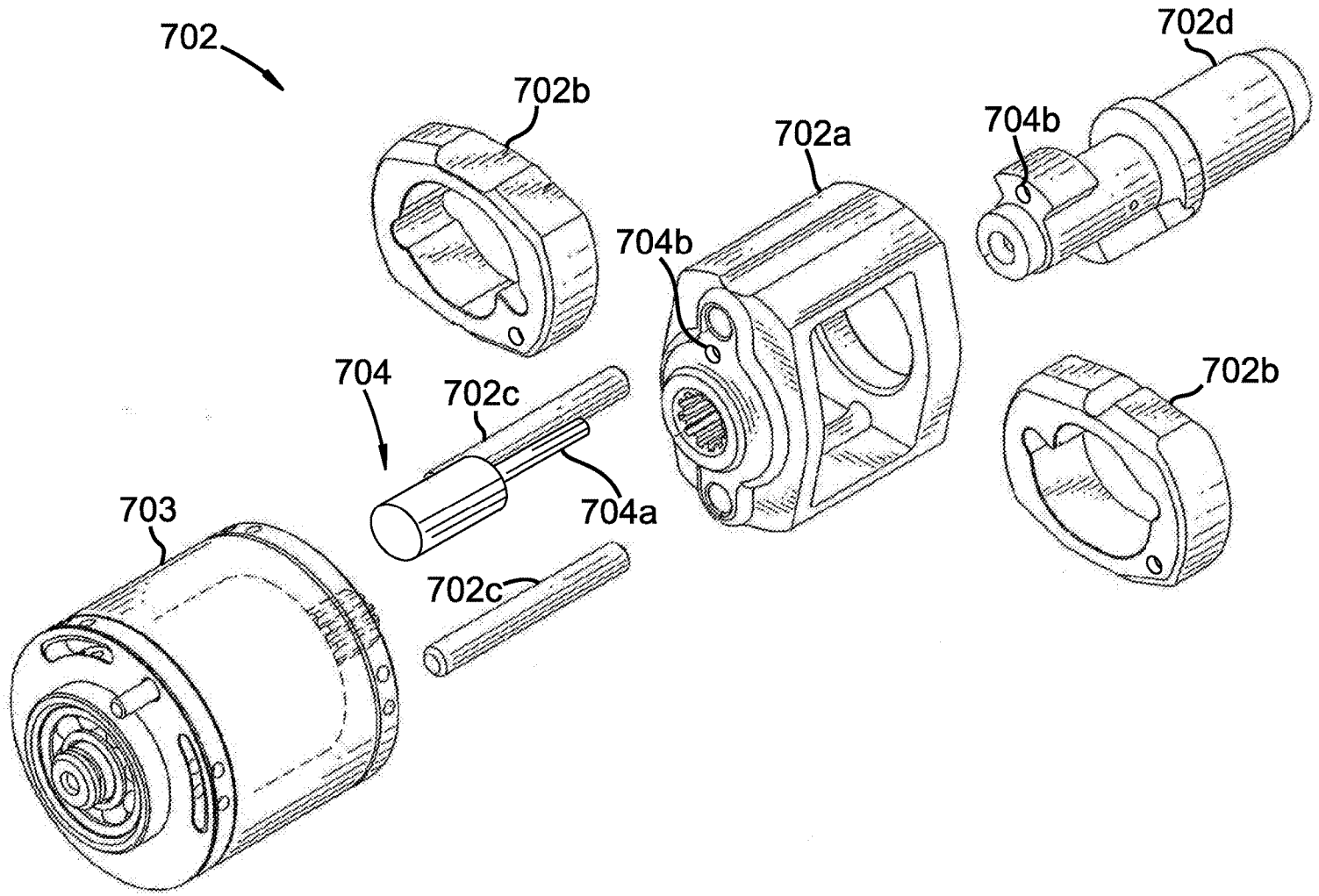

FIGS. 7A-B depict two types of hammer and anvil mechanisms suitable for use with a winch mechanism following the claimed invention. FIG. 7A depicts an isometric cross-section of pin clutch hammer and anvil mechanism 701. Pin clutch 701 includes hammer 701*a* and anvil 701*b*. Hammer 701*a* couples to a motor (such as those described above with regard to FIGS. 2-6), and rotates pins 701*c* around anvil 701*b*, which strike and rotate anvil 701*b*. Anvil 701*b* is coupled to a drum (such as those described above with regard to FIGS. 2-3 and 5-6) via screw cap 701*d*, which fits through an end cap coupled directly the drum and into an end of anvil 701*b*. In some embodiments, screw cap 701*d* is welded and/or otherwise sealed to the end cap. In other embodiments, anvil 701*b* is coupled to the drum via one or more splines extending from anvil 701*b*. And in yet other embodiments, anvil 701*b* is an integrated part of the drum, such that the drum and anvil 701 are monolithic.

FIG. 7B depicts an exploded isometric view of twin hammer clutch hammer and anvil mechanism 702. Clutch 702 includes outside hammer 702*a*, inside hammer 702*b*, hammer pins 702*c*, and anvil 702*d*. Outside hammer 702*a* is coupled directly to motor 703, and is coupled to inside hammer 702 via hammer pins 702*c*. Inside hammer 702*b* impacts anvil 702*d*, which is coupled to a drum (similar to the manner described above with regard to anvil 701*b*). FIG. 7B additionally depicts solenoid 704 with armature 704*a*. Solenoid 704 and armature 704*a* act as a locking pin that locks outside hammer 702*a* to anvil 702*d* as armature 704*a* slides into armature slots 704*b*, thereby preventing free rotation of outside hammer 702*a* with respect to anvil 702*d*. Solenoid 704 is useful, for example, in embodiments where a user desires to directly drive a drum where the required torque is above a threshold torque that triggers the impacting action of the hammer and anvil mechanism.

Figure 8A:
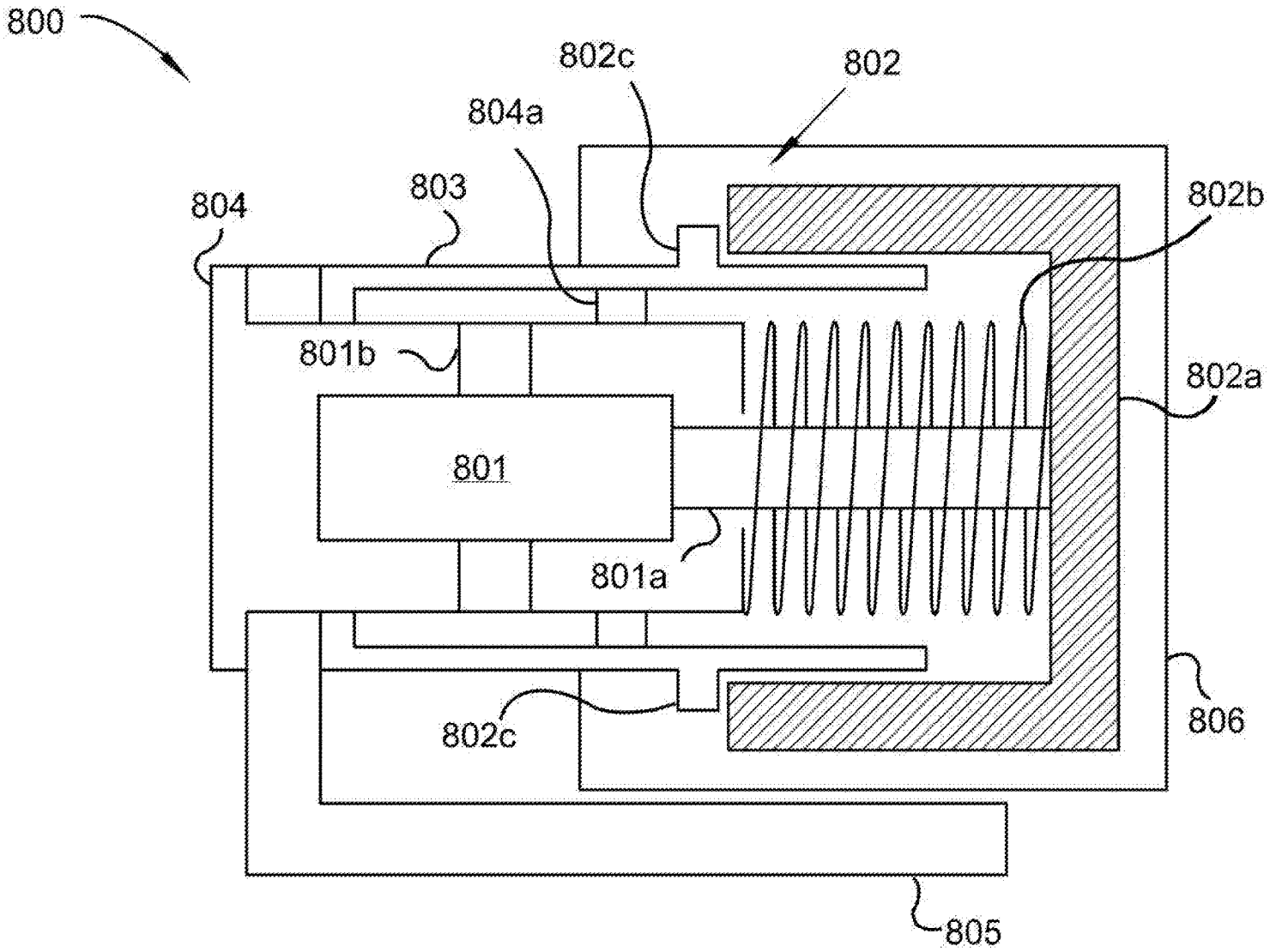
FIGS. 8A-B depict side cross-sectional views of a winch mechanism with a hammer and anvil mechanism around a drum.
Figure 8B:
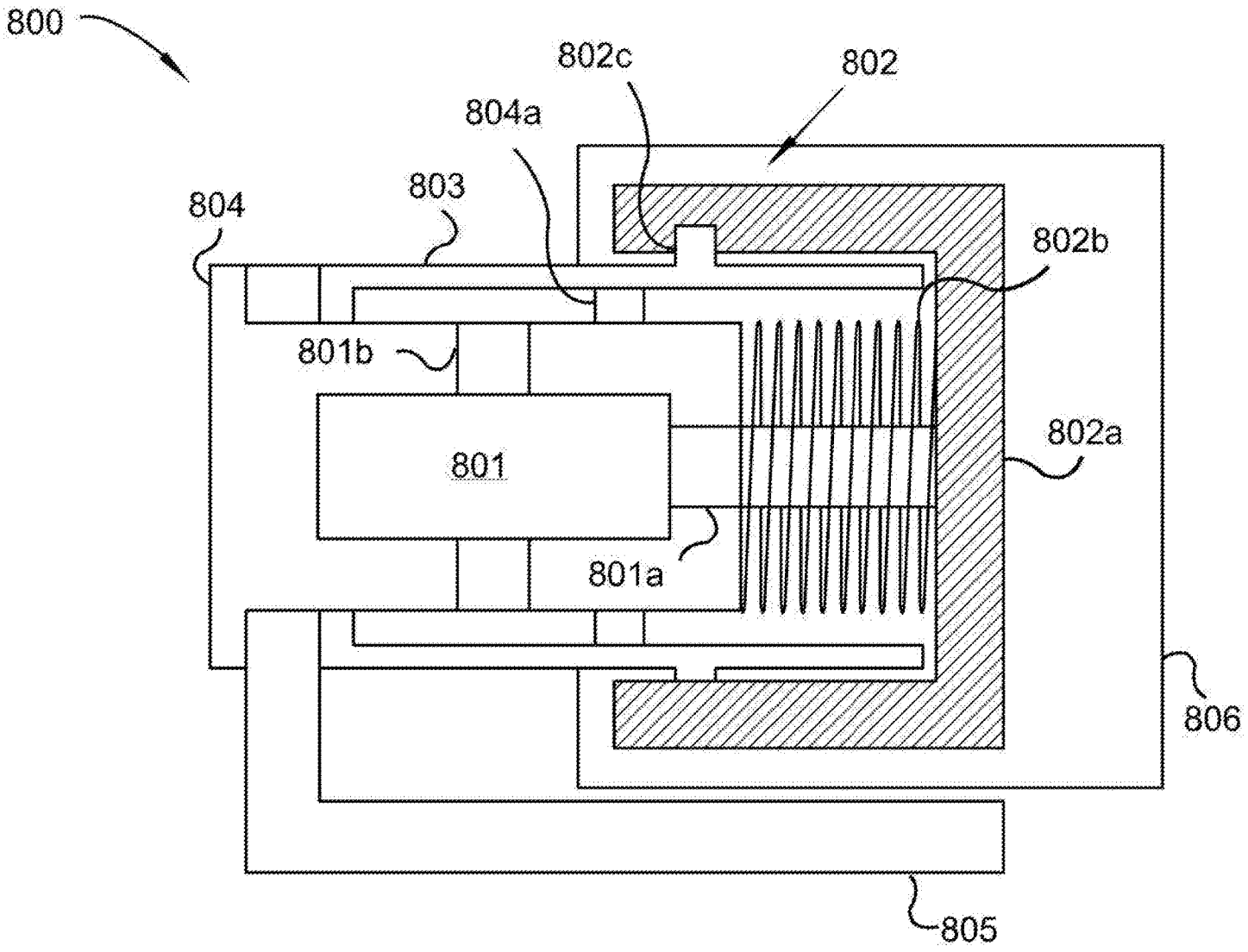

FIGS. 8A-B depict side cross-sectional views of a winch mechanism with a hammer and anvil mechanism around a drum. As depicted in FIG. 8A, winch mechanism 800 includes motor 801, hammer and anvil mechanism 802 including hammer 802*a*, hammer spring 802*b* and anvil 802*c*, drum 803, motor housing 804, side support and mount 805, and sound-proof housing 806. Motor 801 is coupled to hammer 802*a* by coupling rod 801*a*, and rotates hammer 802*a* around one end of drum 803. Hammer spring 802*b* is coupled to motor housing 804 and hammer 802*a* such that hammer 802*a* rotates freely while spring 802*b* remains fixed. Hammer 802*a* has a slight cam such that as hammer 802*a* strikes anvil 802*c*, linear motion is imparted to hammer 802*a*, extending spring 802*b* and forcing hammer 802*a* away from drum 803. As hammer 802*a* passes around anvil 802*c*, spring 802*b* pulls hammer 802*a* back towards drum 803.

Sound-proof housing 806 is disposed around hammer and anvil mechanism 802 and dampens noise created by hammer 802*a* striking anvil 802*c*. In some embodiments sound-proof housing 806 completely surrounds hammer and anvil mechanism 802, whereas in others sound-proof housing 806 only surrounds a portion of hammer and anvil mechanism 802. In some embodiments, drum 803 includes a sound-dampening material to aid in dampening sound. In some specific embodiments, the sound-proof housing and/or sound-dampening material include, but are not limited to, mass-loaded vinyl, Acoustiblok, acoustic foam, and/or combinations thereof.

Drum 803 is rotatably coupled to an inside face of mount 805, whereas motor housing 804 is fixed to mount 805. Motor 801 is fixed to motor housing 804 by motor mount 801*b*. Spacer 804*a* is coupled to, and positioned between, drum 803 and motor housing 804 to maintain spacing between motor housing 804 and drum 803 and provide support for drum 803. Though only one spacer 804*a* is depicted, some embodiments include a plurality of spacers 804*a*.

The invention claimed is:

1. A winch mechanism comprising:

a motor;

a drum mechanism connected to the motor;

a winch line connected to the drum mechanism; and a hammer and anvil mechanism, the hammer connected to the motor and the anvil connected to the drum mechanism within the drum mechanism, wherein the motor activates the hammer and anvil mechanism, by rotating the hammer around the anvil with a higher rotational velocity than the velocity at which the motor could rotate the drum, and the hammer impacts the anvil, rotating the anvil which rotates the drum mechanism causing the drum mechanism to wind up the winch line.

2. The winch mechanism of claim 1, wherein a hammer portion of the hammer and anvil mechanism is coupled to the motor, and wherein an anvil portion of the hammer and anvil mechanism is coupled to the drum mechanism.

3. The winch mechanism of claim 1, further comprising one or more side supports that support the drum mechanism, and wherein the motor is coupled to, and supported by, one or more of the side supports.

4. The winch mechanism of claim 1, wherein the hammer and anvil mechanism comprises a pin clutch hammer and anvil mechanism comprising: a hammer which rotates pins around an anvil causing the pins to strike the anvil, rotating the anvil, thus rotating the drum mechanism.

5. The winch mechanism of claim 1, further comprising an anti-vibration surface mount that mounts the winch mechanism to a mounting surface.

6. The winch mechanism of claim 1, wherein the drum comprises a sound-proof material, and wherein the sound-proof material surrounds at least a portion of the hammer and anvil mechanism.

7. The winch mechanism of claim 6, wherein the sound-proof material comprises mass-loaded vinyl, acoustic foam, or combinations thereof.

8. The winch mechanism of claim 1, further comprising a one-way freewheel clutch coupled to the drum.

9. The winch mechanism of claim 1, further comprising a locking pin that locks a hammer portion of the hammer and anvil mechanism to an anvil portion of the hammer and anvil mechanism and prevents free rotation of the hammer with respect to the anvil.

10. The invention of claim 1, wherein the hammer and anvil mechanism comprises a twin hammer clutch hammer and anvil mechanism comprising:

an outside hammer coupled directly to the motor;

an inside hammer coupled to the outside hammer via hammer pins;

wherein the motor rotates the outside hammer which impacts the hammer pins which impact the inside hammer which impact the anvil causing the drum to rotate.

11. The invention of claim 1, wherein the hammer and anvil mechanism comprises a rocking dog hammer and anvil mechanism.

12. The invention of claim 1, wherein the hammer weighs at least as much as the drum.

13. The invention of claim 1, wherein the anvil is an integrated part of the drum mechanism.

14. The invention of claim 13, wherein the drum and anvil are monolithic.

15. A winch mechanism comprising:

a motor;

a drum mechanism connected to the motor;

a winch line connected to the drum mechanism; and a hammer and anvil mechanism connected to the motor and the drum mechanism, wherein the motor is disposed partially within the drum mechanism, wherein the motor activates the hammer and anvil mechanism, by rotating the hammer around the anvil with a higher rotational velocity than the velocity at which the motor could rotate the drum, and the hammer impacts the anvil, rotating the anvil which rotates the drum mechanism causing the drum mechanism to wind up the winch line.

16. The invention of claim 15, wherein the hammer and anvil mechanism comprises a twin hammer clutch hammer and anvil mechanism comprising:

an outside hammer coupled directly to the motor;

an inside hammer coupled to the outside hammer via hammer pins;

wherein the motor rotates the outside hammer which impacts the hammer pins which impact the inside hammer which impact the anvil causing the drum to rotate.

17. The invention of claim 15, wherein the hammer and anvil mechanism comprises a rocking dog hammer and anvil mechanism.

18. The invention of claim 15, wherein the hammer weighs at least as much as the drum.

19. The invention of claim 15, wherein the anvil is an integrated part of the drum mechanism.

20. The invention of claim 19, wherein the drum and anvil are monolithic.

* * * * *